US010232983B2

(12) United States Patent
Mobarhan

(10) Patent No.: US 10,232,983 B2
(45) Date of Patent: Mar. 19, 2019

(54) MEAL TRAY

(71) Applicant: Ramin Mobarhan, La Jolla, CA (US)

(72) Inventor: Ramin Mobarhan, La Jolla, CA (US)

( * ) Notice: Subject to any disclaimer, the term of this patent is extended or adjusted under 35 U.S.C. 154(b) by 0 days.

(21) Appl. No.: 15/605,887

(22) Filed: May 25, 2017

(65) Prior Publication Data

US 2018/0339807 A1 Nov. 29, 2018

(51) Int. Cl.

| | |
|---|---|
| ***B65G 25/04*** | (2006.01) |
| ***A47G 23/06*** | (2006.01) |
| ***B65D 77/20*** | (2006.01) |
| ***B65D 77/22*** | (2006.01) |
| ***B65D 81/34*** | (2006.01) |
| ***B65D 25/04*** | (2006.01) |

(52) U.S. Cl.

CPC ..... *B65D 25/04* (2013.01); *A47G 23/06* (2013.01); *B65D 77/2024* (2013.01); *B65D 77/22* (2013.01); *B65D 81/3453* (2013.01)

(58) Field of Classification Search

CPC ..... B65D 25/04; B65D 77/2028; B65D 77/2032; B65D 77/2072; B65D 77/2068; B65D 77/2024; B65D 81/3453; B65D 81/3446; B65D 81/34; B65D 21/0208; B65D 21/0205; B65D 21/0204; B65D 21/0202; B65D 21/0201; B65D 21/02; B65D 1/34; B65D 1/36; B65D 1/22; B65D 1/24; A47G 23/06; A47G 23/0633

USPC ..... 220/23.4, 23.2, 23.83, 556, 555, 553, 220/359.4, 359.2, 359.1; 206/216, 206/541–549; 426/106, 112–114, 119, 426/120

See application file for complete search history.

(56) References Cited

U.S. PATENT DOCUMENTS

| | | | | | |
|---|---|---|---|---|---|
| 1,576,088 | A * | 3/1926 | Bunz | A45D 33/003 | 206/541 |
| 2,752,037 | A * | 6/1956 | Vogt | B65D 71/0085 | 206/459.5 |
| 3,185,578 | A * | 5/1965 | Scharre | B65D 77/2008 | 426/114 |
| 3,305,126 | A * | 2/1967 | Cease | B65D 1/36 | 206/508 |
| 3,401,863 | A * | 9/1968 | Earl | B65D 1/36 | 220/645 |
| 3,651,976 | A * | 3/1972 | Chadbourne | B65D 1/30 | 206/503 |
| 3,983,999 | A * | 10/1976 | Morton | B65D 21/0206 | 206/526 |

(Continued)

FOREIGN PATENT DOCUMENTS

GB 1077440 A * 7/1967 ..... B65D 77/2032

*Primary Examiner* — Robert J Hicks
(74) *Attorney, Agent, or Firm* — Ramin Mobarhan

(57) ABSTRACT

A meal tray comprising a plurality of divided compartments each having a substantially planar bottom portion and an encompassing wall extending upwardly therefrom to form an open upper end of the divided compartment, each divided compartment dimensioned to receive a different portion of a meal; an encompassing tray rim defining an open upper end of the meal tray; and a first tear portion comprising a first tear line defining a boundary of a divided compartment from at least one other divided compartment, the first tear portion configured to facilitate a separation of the defined divided compartment from at least one other divided compartments along the first tear line.

20 Claims, 9 Drawing Sheets

(56) References Cited

U.S. PATENT DOCUMENTS

| | | | | | |
|---|---|---|---|---|---|
| 4,875,620 | A * | 10/1989 | Lane, Sr. | B65D 1/26 | 206/820 |
| 5,123,527 | A * | 6/1992 | Hustad | B65D 1/36 | 206/549 |
| 5,353,985 | A * | 10/1994 | Nageli | B65D 1/36 | 220/524 |
| 5,409,127 | A * | 4/1995 | Stratford | B65D 1/30 | 220/23.4 |
| 5,919,501 | A * | 7/1999 | Rozzano | B65D 21/0233 | 206/459.5 |
| 2003/0141218 | A1* | 7/2003 | Stephens | B65D 1/30 | 206/484 |
| 2010/0247719 | A1* | 9/2010 | Everard | A23G 3/54 | 426/120 |
| 2018/0084934 | A1* | 3/2018 | Kang | B65D 1/30 | |

* cited by examiner

MEAL TRAY

BACKGROUND

Aspects of the disclosure relate to food containers with multiple compartments for housing different portions of a meal. Food containers such as disposable food trays for microwavable meals or carry outs, are prevalent in the market. Typically, each compartment of a food container is purposed to house a different portion of a meal, such as a salad, a main course, and a dessert. Following the housing of these meal portions in their respective compartments, the open top portion of the food container may then be closed, such via a cover or lid for carry outs, or sealed, such as via a thermoplastic material, for microwavable meals.

A problem with the forgoing approach is that different portions of a meal are often intended or desired to be consumed at different temperatures, For example, the salad portion may be most desirably served at room temperature, while the main course served hot, and the dessert at cold temperatures. Currently, all three portions are placed in a single integrally formed tray which results in heating, such as in a microwave, of the entire tray to one temperature, which may not be desirable for some or all of the different portions of the meal.

To avert the above, different portions of a meal may first have to be manually transferred from the container to another medium, such as a plate, in an often cumbersome process. In addition, for sealed meals, such approach necessitates breaking of the seal for the entire tray, resulting in a loss of protection offered by the seal, such as for preserving freshness or reducing freezer frost, for the portions desired to be consumed at a later time, or date.

Exemplary embodiments of the disclosure address these problems, both individually and collectively.

BRIEF DESCRIPTION OF THE DRAWINGS

Aspects of the disclosure are illustrated by way of example. In the accompanying figures, like reference numbers indicate similar elements.

DETAILED DESCRIPTION

Examples are described herein in the context of a meal tray with multiple compartments for housing different portions of a meal. Embodiments provided in the following description are illustrative only and not intended to limit the scope of the present disclosure. Reference will now be made in detail to implementations of examples as illustrated in the accompanying drawings. The same reference indicators will be used throughout the drawings and the following description to refer to the same or like items.

In the interest of clarity, not all of the routine features of the examples described herein are shown and described. It will, of course, be appreciated that in any such actual implementation, numerous implementation-specific details may nevertheless exist in order to achieve goals such as compliance with application- and business-related constraints, and that these specific goals can vary from one implementation to another.

Figure 1:
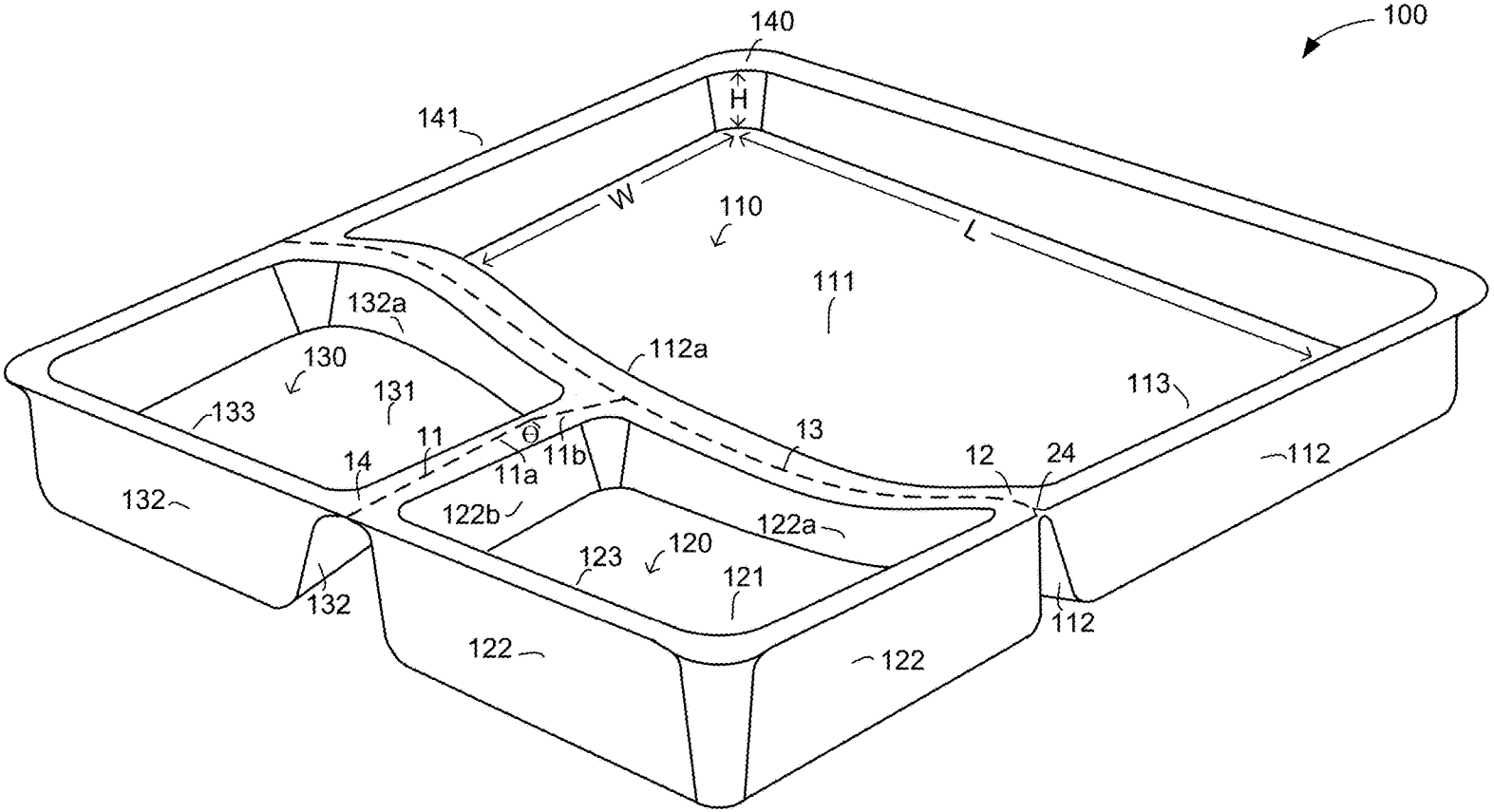
FIG. 1 illustrates a perspective view of a meal tray in which various aspects of the disclosure can be implemented.

FIG. 1 is a perspective view of an exemplary meal tray 100 in which various aspects of the disclosure can be implemented. As shown in FIG. 1, exemplary meal tray 100 includes a set of divided compartments, such as 110, 120 and 130, each having a substantially planar bottom portion, such as 111, 121 and 131 respectively, and an encompassing wall, such as 112, 122 and 132 respectively, which extends upwardly from their respective planar bottom portions to form an open upper end of each divided compartment, such as open upper ends 113, 123 and 133, respectively. For simplicity of illustration, meal tray 100 in FIG. 1 is shown as generally rectangular in shape with three divided compartments, although meal trays having different number of divided compartments (e.g. two, four, etc.), and configured to various multi-sided shapes (e.g. triangular, hexagonal, etc.), oval or circular forms (e.g. a plate) with angularly divided compartments (i.e. sectors), are also contemplated to be within the scope of present disclosure.

As also shown in FIG. 1, an encompassing tray rim 140 defines an open upper end 141 of meal tray 100. Interior portions of encompassing tray rim 140 may include, or be integrally formed with, upper portions (e.g. upper edges) of encompassing walls 112, 122 and 132. In an exemplary embodiment, meal tray 100 is of a composition transparent to microwave energy, such as of a polystyrene foam, moldable thermoplastic, or a polymer composition, and is "microwave safe", which is generally known as configured to safely withstand exposure to a microwave energy during heating in a microwave oven with little or no adverse effect imparted on a meal in a meal tray.

In an exemplary embodiment, each divided compartments 110, 120 and 130 is dimensioned to receive different portion(s) of a meal (not shown). For purposes of this disclosure, a "meal" may refer to an ensemble of different courses (or dishes), such as a main course, appetizer, dessert, etc; or alternatively, to a single dish assembled from discrete components, such as a sandwich assembly of bread, meat, cheese, vegetable etc. A meal "portion" may refer to a course (or dish), to a discrete component in a course, or both.

In the example of FIG. 1, divided compartment 110 may be dimensioned to receive a main course portion of a meal, while divided compartments 120 and 130, are dimensioned to respectively receive the appetizer and dessert portions of the meal. Alternatively, in case of a single course meal such as a sandwich, divided compartment 110 may be dimensioned for a bread portion, while divided compartments 120 and 130, are dimensioned to respectively receive meat(s) and cheese(s) portions of a sandwich. In an exemplary embodiment, at least one divided compartment in meal tray 100 is dimensioned differently than the other divided compartments. In the example meal tray 100 shown in FIG. 1, divided compartment 110 is configured as substantially larger than divided compartments 120 and 130, so to receive the main course portion which is of a larger volume than appetizer or dessert portions, for which the relatively smaller divided compartments 120 and 130 are respectively configured.

In an exemplary embodiment, each divided compartment has a dimensional aspect ratio in which its corresponding substantially planar bottom portion has a length, or width (or both) that is substantially greater than the height of the encompassing wall of its corresponding divided compartment. In the example shown in FIG. 1, the substantially planar bottom portion 111 has a length "L" and width "W" that are each substantially greater than height "H" of encompassing wall 112 of its corresponding divided compartment 110. In an exemplary embodiment (not shown) in which meal tray 100 is of a substantially circular form, such as a plate with angularly divided compartments (i.e. sectors), each divided compartment has a dimensional aspect ratio wherein the length of its encompassing radii walls and arc are substantially greater than its height.

In an exemplary embodiment, at least one meal portion is configured for consumption at a substantially different temperature than the other meal portions. For example, the main course placed in divided compartment 110 is to be desirably served hot, while the dessert placed in divided compartment 130 is to be desirably served at cold or below freezing temperatures (e.g. below 32 degrees Fahrenheit) while a salad or an appetizer placed in divided compartment 120 is to be desirably served at room temperature. As previously mentioned, placement of the above three portions in a single integrally formed meal tray results in a heating, such as in a microwave, of the entire tray to one temperature which may not be desirable for some or all of the different meal portions. Exemplary embodiments of the disclosure addresses the above problem in the manner described below.

As shown in FIG. 1, meal tray 100 includes tear portion(s), such as 12, which comprise a tear line, such as 13, which define a boundary of a divided compartment, such as divide compartment 110, from other divided compartment(s), such as 120 and 130, and vice versa. Likewise, tear portion 14 comprise a tear line 11 which defines a boundary of a divided compartment 120 from the divided compartment 130, and vice versa. As explained below and in greater detail, such as in conjunction with FIGS. 2A-E, a tear portion, such as 12, is configured to facilitate a separation of adjoining divided compartment(s), such as 110 from 120 and 130, along their common tear line, such as 13.

FIGS. 2A-E are partial magnified views of meal tray 100 of FIG. 1, further illustrating various exemplary implementations of a tear portion, such as tear portion 12, and a corresponding tear line, such as tear line 13. As shown in in FIG. 2A, tear portion 12 includes sub-portions 12*a* and 12*b* on either side of its corresponding tear line 13. In the example shown, tear line 13 is defined by a set of perforations, such as 20-1, 20-2, 20-3, and so on. A perforation, such as 20-1, penetrates the full thickness of tear portion 12, shown symbolically as d1, with a hollow portion 200 between opening 201 at top surface 21, and opening 202 at bottom surface 22. For simplicity of illustration, tear portion 12 is shown as having a uniform thickness d1 in FIG. 2A, but it is contemplated for a tear portion to have varying thicknesses along the path of a tear line and therefore the depth d1 of a hollow portion 200 may vary among perforations. In addition, perforation(s) may be of various shapes, such as a narrowing, spherical or other symmetrical or non-symmetrical shape(s) at either its opening(s) 201, 202, or hollow portion 200, and perforation(s) can be intermittently or equally distanced from each other. Perforations, such as 20-1, 20-2, 20-3 etc., can be integrally formed with meal tray 100, such as from a mold, or subsequently formed, such as via a perforating device.

Figure 2A:
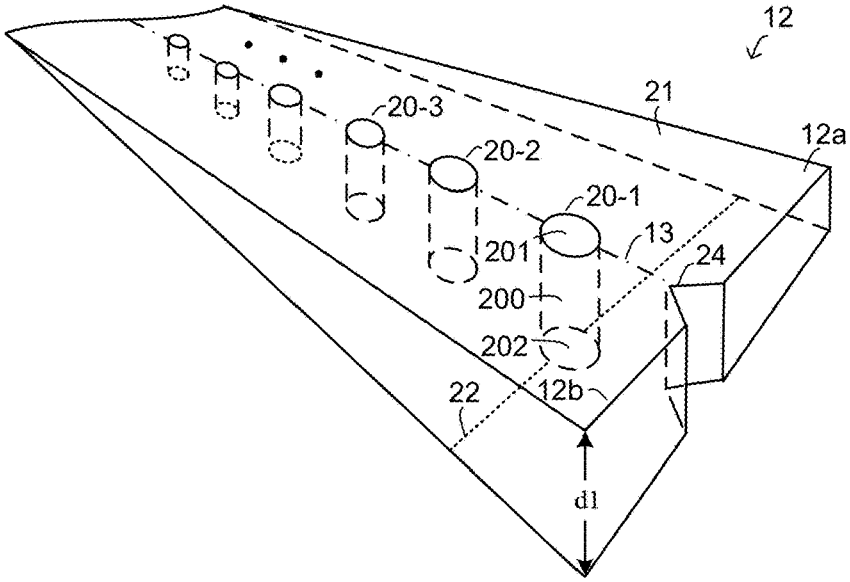
FIGS. 2A-E are magnified partial views of meal tray of FIG. 1, further illustrating various exemplary implementations of tear lines.
Figure 2B:
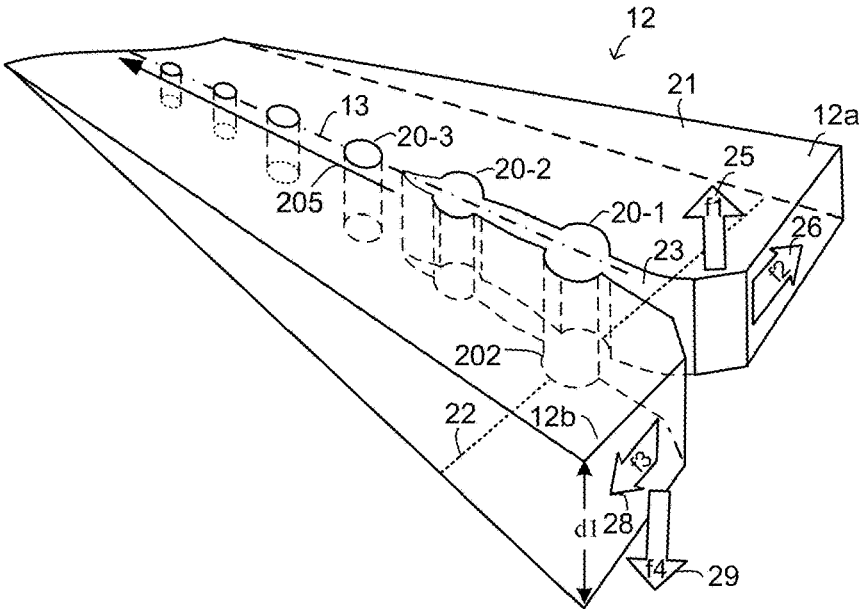

As shown in FIG. 2B, application of external force(s) on tear portion 12, such as upward force f1, lateral forces f2 or f3, or downward force f1 in the directions 25, 26, 28, or 29 respectively, cause a tear 23 to form on tear portion 12 to separate sub-portions 12*a* and 12*b* along tear line 13. Perforations are configured to structurally weaken (to within safe limits) a tear portion to facilitate separation of sub-portion 12*a* from 12*b* and to guide advancement of tear 23 along tear line 13 in general direction of arrow 205, which ultimately results in a full separation of a divided compartment, such as 110 from other divided compartments, such as 120 and 130, as further described below and in greater detail in conjunction with FIGS. 3A-B.

It should be noted that external force(s) may be applied to either or both sub-portions 12*a* and 12*b*, and in any direction(s) that result in a separation of sub-portions 12*a* and 12*b*. In an exemplary embodiment, a tear line, such as 13, may include a leading (or starter) nick 24 formed at one end of tear line located at an outer perimeter of the encompassing tray rim 140, such as for example shown in FIG. 1 and FIGS. 2A-C. Nick 24 is configured to further facilitate initiating a separation in a tear portion along its corresponding tear line.

Figure 2C:
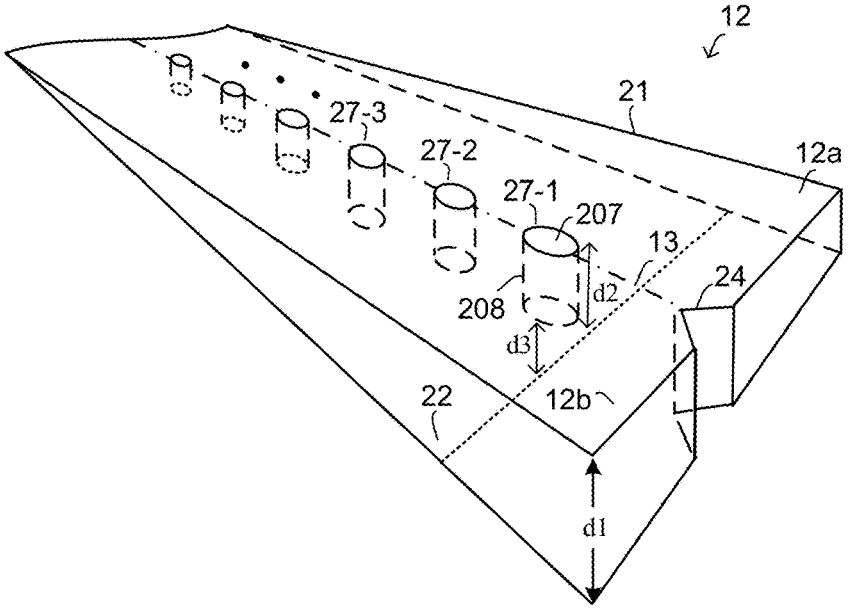

FIG. 2C illustrates another exemplary implementation in which tear line 13 is defined by a set of indentations such as 27-1, 27-2, 27-3 and so on. An indentation, such as 27-1, has an opening 207 on top surface 21 and extends in a hollow portion 208 into tear portion 12 to a depth d2, wherein d2 is less than d1 thickness of tear portion 12 by a thickness d3, as symbolically shown in FIG. 2B. In an exemplary embodiment, d3 is of substantially smaller thickness than d2 such that hollow portion 208 penetrates tear portion 12 to within a close proximity of bottom surface 22. For simplicity of illustration, tear portion 12 is shown as having a uniform thickness d1 in FIG. 2B, but it is contemplated for a tear portion to have varying thicknesses along the path of a tear line and therefore d1, d2 and d3 may vary among indentations. In addition, indentation(s) may be of various shapes, such as narrowing, spherical or other symmetrical or non-symmetrical shape(s) at its opening 207 or hollow portion 208, and can be intermittently or equally distanced from each other. Indentations, such as 27-1, 27-2, 27-3, etc., can be integrally formed with meal tray 100, such as from a mold, or subsequently formed, such as via an indenting device.

Similar to perforations in FIGS. 2A-B, indentations are configured to structurally weaken (to within safe limits) a tear portion to facilitate a separation of sub-portion 12*a* from 12*b*, such as due to application of external force(s), to guide advancement of a tear along tear line 13 (as previously described in conjunction with FIG. 2A), which ultimately results in a full separation of a divided compartment from other divided compartments, as further described below and in greater detail in conjunction with FIGS. 3A-B. A nick 24 may also be present to further facilitate initiating a separation of tear portion along its corresponding tear line.

Figure 2D:
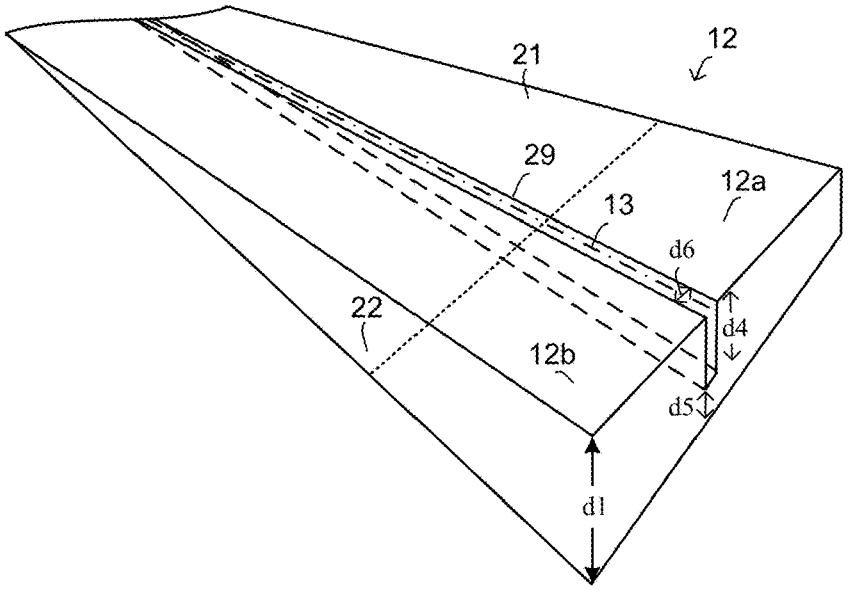

FIG. 2D illustrates another exemplary implementation in which tear line 13 is defined by groove(s) 29 having an opening of width d6, and depth d4, wherein d4 is less than d1 thickness of tear portion 12 by a thickness d5, as symbolically shown in FIG. 2D. In an exemplary embodiment, d5 is of substantially smaller thickness than d4. For simplicity of illustration, tear portion 12 is shown as having a uniform thickness d1 in FIG. 2D, but it is contemplated for a tear portion to have varying thicknesses along the path of a tear line and therefore the distances d1, d4 and d5 may vary among different locations along tear portion 12. In addition, in the example of FIG. 2D, groove 29 is shown as having an substantially uniform and rectangular profile, although other various profile shapes (e.g. V-shaped, semi-circular, etc.) having different width d6 and depth d4 at various parts are also contemplated to be within the scope of this disclosure.

For simplicity of illustration, nick 24 is not shown for groove 29 configuration in FIG. 2D, although inclusion of a nick 24 with a groove is contemplated to be within the scope of the present disclosure. Groove 29 can be integrally formed with meal tray 100, such as from a mold, or subsequently formed, such as via an etching device. In the example shown in FIG. 2D, groove 29 extends in depth to a close proximity of bottom surface 22, although it is contemplated for a groove to conversely have its opening at bottom surface 22 and to extend in depth to within a close proximity of top surface 21.

Similar to perforations and indentions discussed in FIGS. 2A-C, groove(s) 29 is configured to structurally weaken (to within safe limits) a tear portion to facilitate a separation of sub-portions 12*a* and 12*b*, such via application of external force(s), and to guide advancement of a tear along tear line 13 (as previously described in conjunction with FIG. 2B), which ultimately results in a full separation of a divided compartment from other divided compartments, as further described below and in greater detail in conjunction with FIGS. 3A-B.

Figure 2E:
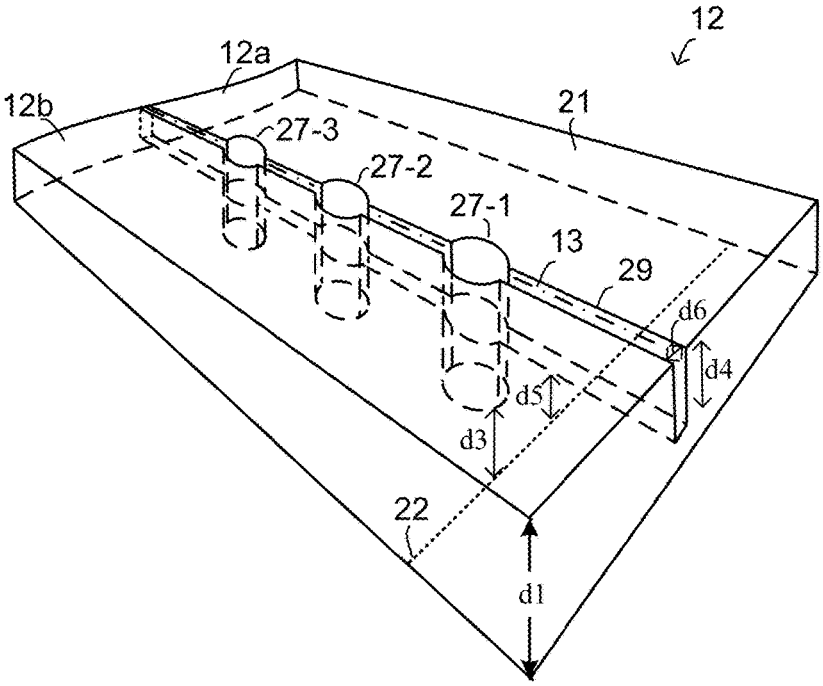

It is contemplated that a tear line 13 can be defined by a combination of, perforations, indentations and grooves, such as for example groove(s) 29 placed in between a set of indentations 27-1, 27-2, 27-3 and so on, as shown in FIG. 2E, in which d5 for groove(s) 29 may be smaller, larger or substantially same size as d3 for an indentation, such as 27-1. In addition, perforations, indentations and grooves which may individually or collectively define a tear line are configured to be a guide and a path of lesser resistance for a cutting device (not shown), such as scissor or knife, applied by a user in separating sub-portions 12*a* and 12*b*.

In an exemplary embodiment, at least a portion of a tear line, such as tear line 13 shown in FIG. 1, has a curvature configuration to impart structural support, such as contribute to rigidity, to its corresponding tear portion 12, so to sufficiently maintain a structural integrity of tray 100 by reducing its bending (if any) along a tear line to within acceptable levels. The curvature configuration may include a substantially sinusoidal pattern with predetermined or varying amplitude or wavelength (or period). At least a portion of an encompassing wall (such as portion 112*a* of encompassing wall 112, portion 122*a* of encompassing wall 122, or portion 132*a* of encompassing wall 132) that is adjacent to tear portion 12 may include a curvature configuration that is defined by (or follows) the curvature of tear line 13 corresponding to tear portion 12 so that a rim boundary of a divided compartment, such as boundary 112*a* of divided compartment 110, is curved to match or trace the curvature of its boundary defined by its tear line 13. A tear portion may include (or overlap with) upper portion(s) (such as edges) of encompassing wall(s) for each of its adjacent divided compartments.

In an example alternative, at least a portion of a tear line, such as tear line 11 shown in FIG. 1, has (or is defined by) two or more sub-lines, such as 11*a* and 11*b*, intersecting at a substantially abrupt angle, such as θ, and has a configuration to impart rigidity to its corresponding tear portion 14, and meal tray 100 as a whole. Sub-lines may alternate in their direction(s) to intersect each other at angle(s) ranging from acute to obtuse, such as in a "zig zag" pattern. At least a portion of an encompassing wall may include configuration defined by its corresponding tear line with sub-lines intersecting at a substantially abrupt angle, although portion(s) of encompassing wall(s) such as portions 122*b* of encompassing wall 122, may have a configuration different than its corresponding tear line, such as a straight (non-curved) configuration of portion 122*b* of encompassing wall 122 having a corresponding angled tear line 11.

Figure 3A:
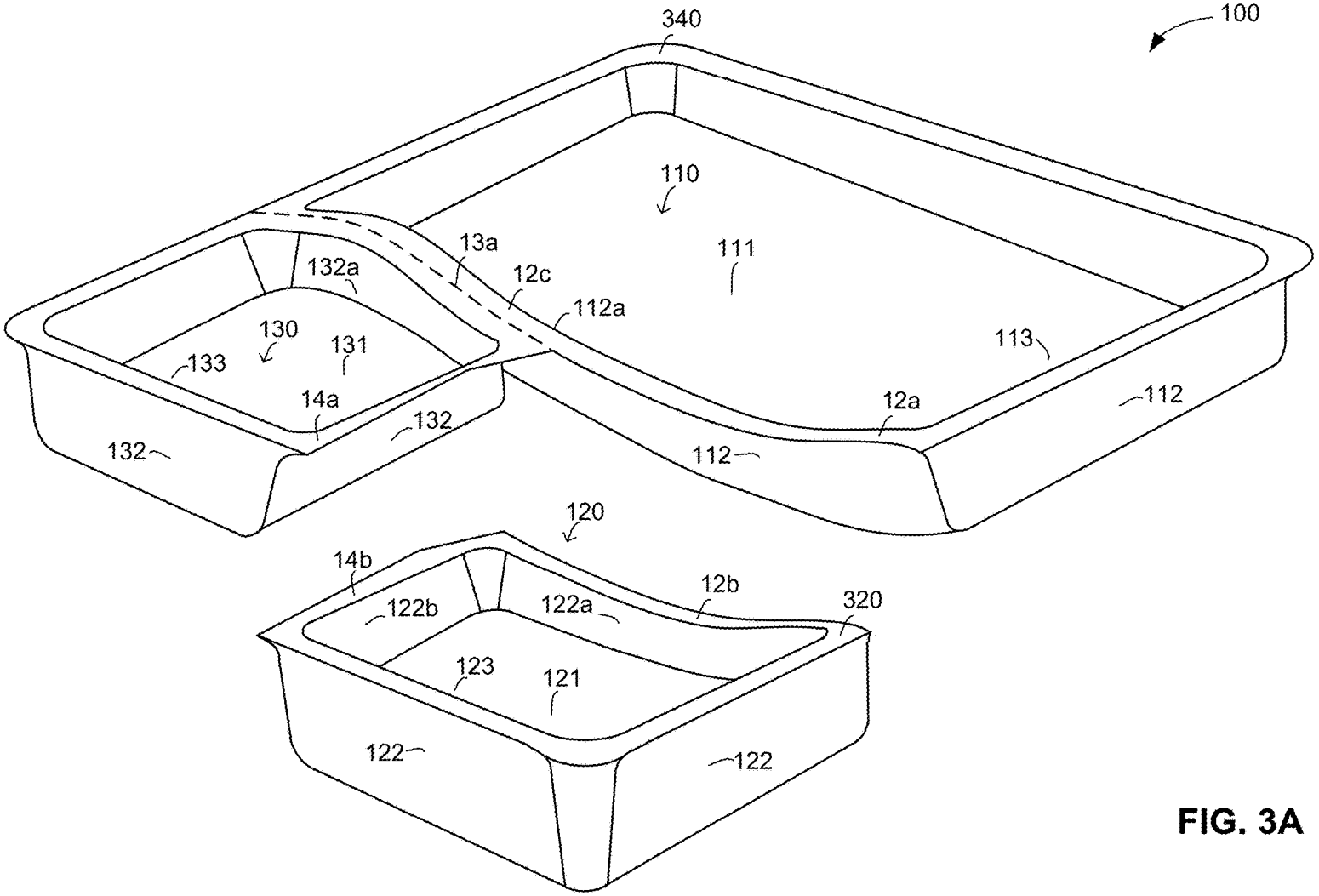
FIGS. 3A-B illustrate exemplary perspective views of the separated divided compartments of meal tray of FIG. 1.
Figure 3B:
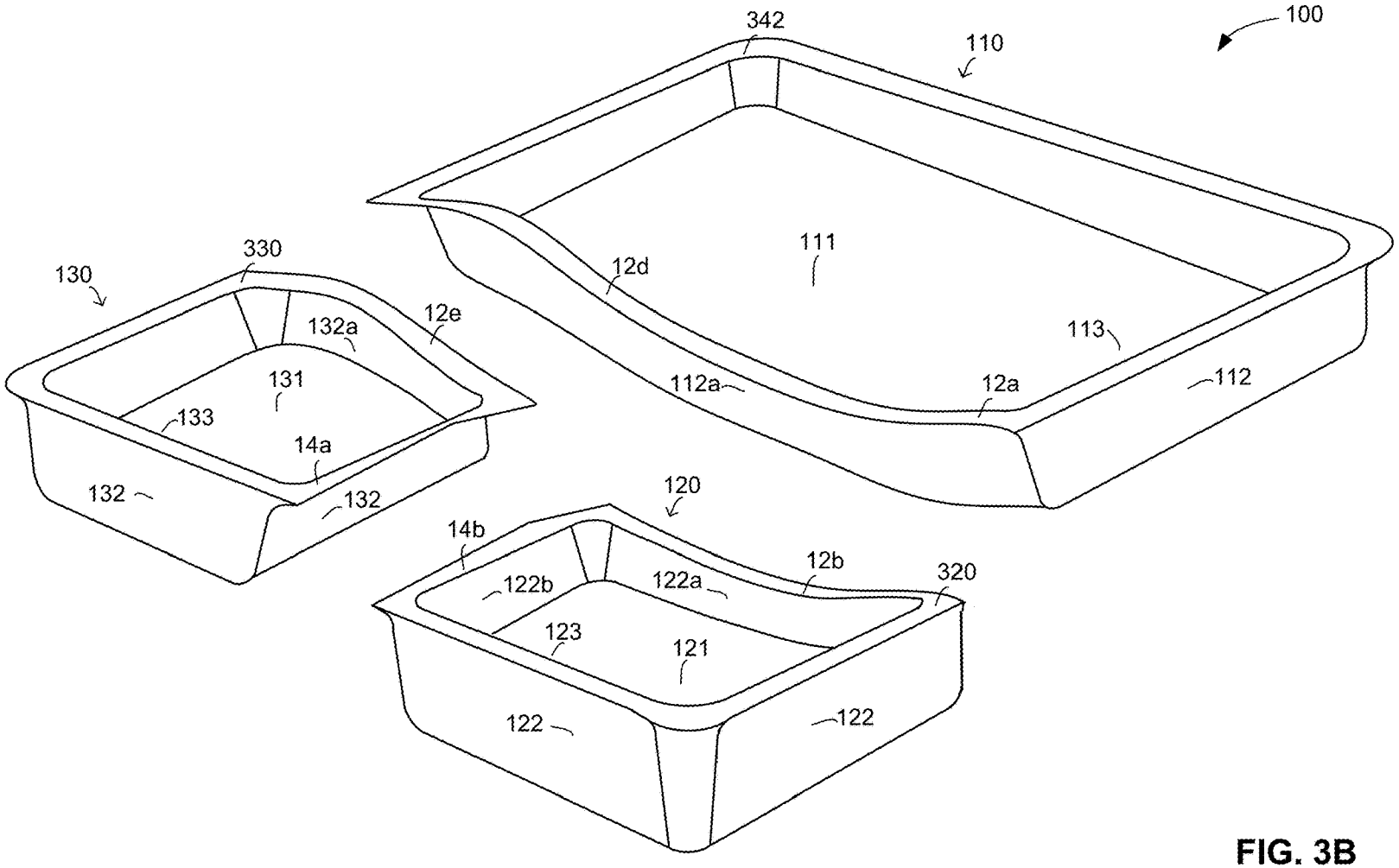

FIGS. 3A-B illustrate exemplary perspective views of the separated divided compartments of meal tray 100. As shown in FIG. 3A, divided compartment 120 has been separated from other divided compartments 110 and 130 of meal tray 100 along tear lines 13 and 11 (shown in FIG. 1), in the manner described above in conjunction with FIGS. 2A-E. Sub-portions 12*b* and 14*b* (of tear portion 14) have now become part of an encompassing rim 320 for separated divided compartment 120. Likewise, sub-portions 12*a* and 14*a* (of tear portion 14) have become part of an encompassing tray rim 340 for remainder of meal tray 100. Meal tray 100 now includes remainder of tear portion 12 and tray line 13 in form of tear portion 12*c* and tear line 13*a*, respectively, which can be used to separate divided compartments 130 from 110 as shown in FIG. 3B. Sub-portions 14*a*, and 12*e* (of tear portion 12*c*) have now become part of encompassing rim 330 for separated divided compartment 130, while sub-portions 12*a* and 12*d* have now become part of encompassing tray rim 342 for divided compartment 110.

Separation of one or more divided compartments 110, 120 and 130 from the others enables each meal portion contained therein to be desirably consumed at a substantially different temperature(s) than the other meal portions without having to be first transferred to another case to avoid being heated or cooled with the other meal portions in meal tray 100.

Figure 4:
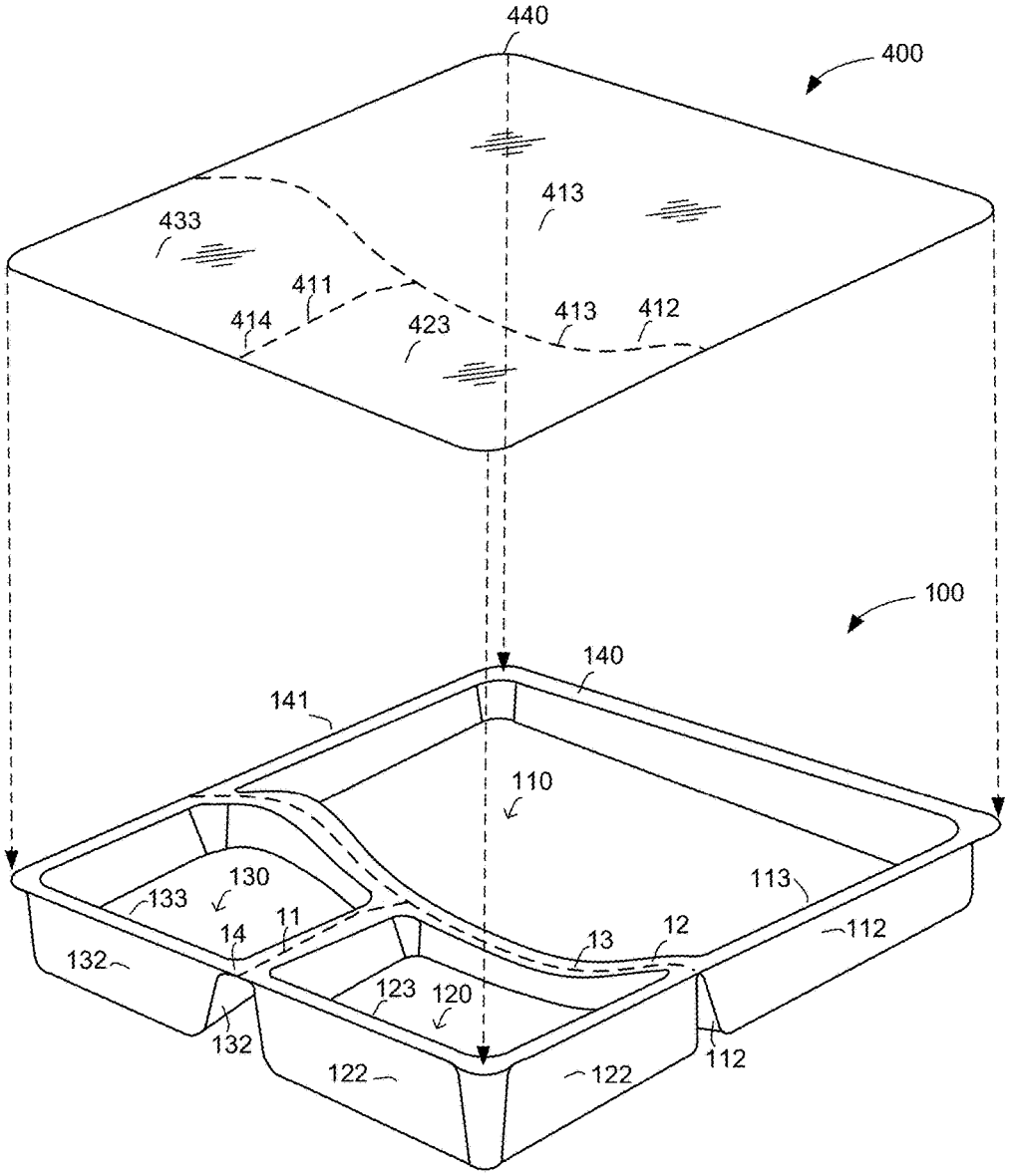
FIG. 4 illustrates an exemplary perspective view of a flexible cover sheet configured to couple to meal tray of FIG. 1.

FIG. 4 illustrates an exemplary perspective view of a flexible cover sheet 400 with a boundary 440 configured to couple or attach, such as adhesively or via heat-sealing or a combination thereof, to encompassing tray rim 140 and boundaries of two or more of divided compartments 110, 120 and 130 of meal tray 100. Flexible cover sheet 400 is dimensioned to individually seal open end(s) 113, 123 and 133 of at least two adjacent divided compartments, such as 110, 120 and 130, by having a length and width (or radius) dimensioned larger than the corresponding length and width (or radius) of the open ends of the at least two adjacent divided compartments. Flexible cover sheet 400 is removably coupled, such via an adhesive layer or heat sealing, which maintains a seal on a divided compartment while allowing a user to remove flexible cover sheet 400 with rather ease.

As shown in FIG. 4, the flexible cover sheet 400 includes tear portions 412 and 411, with respective tear lines 413 and 414, which define a boundary for sub-portions 413, 423 and 433 of cover sheet 400. Tear lines 413 and 414, are configured to be positioned to substantially transpose on tear lines 13 and 14, respectively, so cover sheet sub-portions 413, 423 and 433 respectively seal open end(s) 113, 123 and 133 of divided compartments 110, 120 and 130. In an exemplary embodiment, flexible cover sheet 400 is of a transparent composition, translucent composition or a combination thereof, such as plastic. Tear lines 411 and 413 in cover sheet 400 may be integrally formed with cover sheet 400, such as from a mold, or subsequently formed, such as via a perforating, indenting, or etching device.

Figure 5A:
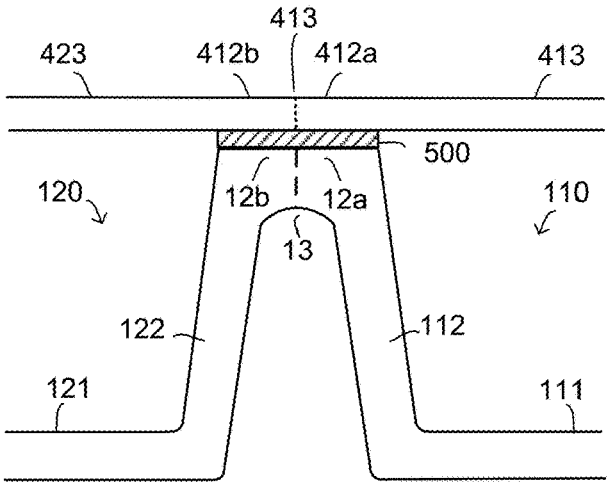
FIGS. 5A-B illustrate exemplary cross-sectional views of the flexible cover sheet of FIG. 4 coupled to meal tray of FIG. 1.
Figure 5B:
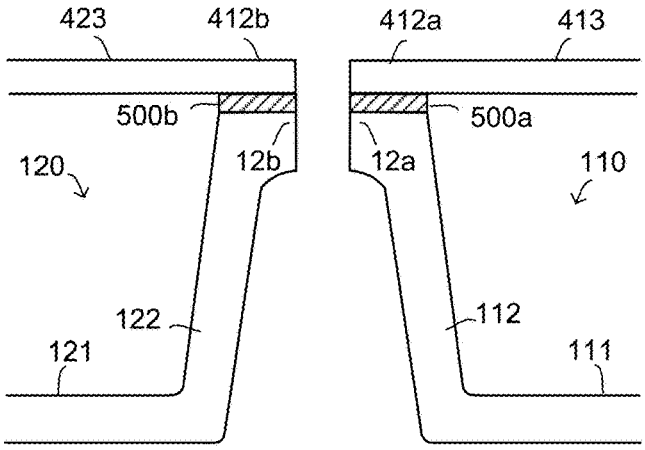

FIGS. 5A-B illustrate exemplary cross-sectional views of flexible cover sheet 400 coupled to meal tray 100, such as in vicinity of tear lines 413 and 13. As shown in FIG. 5A, tear portions 412*a* and 412*b* of cover sheet sub-portions 413 and 423 in flexible cover sheet 400 are respectively coupled, such as via adhesive layer 500 or heat-sealing, to tear portions 12*a* and 12*b* of divided compartments 110 and 120 in meal tray 100, with respective tear lines 413 and 13 substantially transposed. As shown in FIG. 5B, separation of divided compartments 110 from 120 along tear line 13, results in a similar separation of sub-portions 413 and 423 along tear line 413. Adhesive layer 500 also separates into sub-portions 500*a* and 500*b* (or alternatively heat-sealed 412*a* and 412*b* portions separate to 12*a* and 12*b*, respectively) and therefore cover sheet sub-portions 413 remains coupled to and maintains its seal of divided compartments 110, while cover sheet sub-portions 423 remains coupled to and maintains its seal of divided compartments 120, therefore preserving a sealed state of each separated divided compartment 110 and 120.

Figure 6:
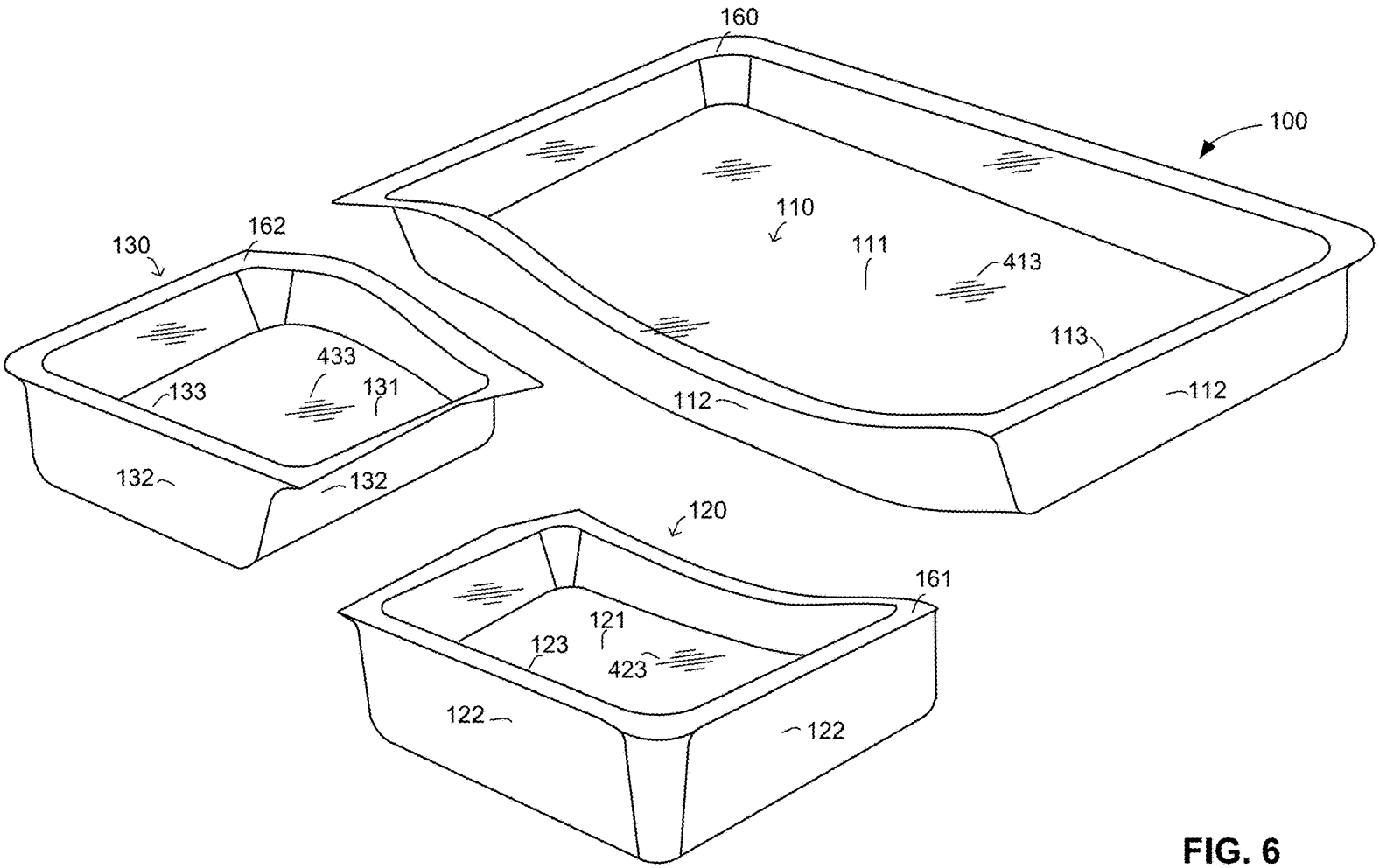
FIG. 6 illustrates exemplary perspective views of sub-portions of flexible cover sheet coupled to divided compartments of meal tray after separation of divided compartments.

FIG. 6 illustrate exemplary post-separation perspective views of sub-portions 413, 423 and 433 while respectively coupled to encompassing rims 160, 161 and 162 of divided compartments 110, 120 and 130. A sealed separation of one or more divide portions 110, 120 and 130 from the others enables a consumer to save portion(s) of the meal, such as in a freezer, for consumption at substantially different times than the other meal portion(s).

The previous description is provided to enable any person skilled in the art to practice the various aspects described herein. Various modifications to these aspects will be readily apparent to those skilled in the art, and the generic principles defined herein may be applied to other aspects.

The foregoing description has been presented only for the purpose of illustration and description and is not intended to be exhaustive or to limit the disclosure to the precise forms disclosed. Numerous modifications and adaptations thereof will be apparent to those skilled in the art without departing from the spirit and scope of the disclosure.

Reference herein to an example or implementation means that a particular feature, structure, operation, or other characteristic described in connection with the example may be included in at least one implementation of the disclosure. The disclosure is not restricted to the particular examples or implementations described as such. The appearance of the phrases "in one example," "in an example," "in one implementation," or "in an implementation," or variations of the same in various places in the specification does not necessarily refer to the same example or implementation. Any particular feature, structure, operation, or other characteristic described in this specification in relation to one example or implementation may be combined with other features, structures, operations, or other characteristics described in respect of any other example or implementation.

Use herein of the word "or" is intended to cover inclusive and exclusive OR conditions. In other words, A or B or C includes any or all of the following alternative combinations as appropriate for a particular usage: A alone; B alone; C alone; A and B only; A and C only; B and C only; and A and B and C.

What is claimed is:

1. A meal tray comprising:

a plurality of divided compartments each having a substantially planar bottom portion and an encompassing wall extending upwardly therefrom to form an open upper end of the divided compartment, each divided compartment dimensioned to receive a different portion of a meal;

an encompassing tray rim defining an open upper end of the meal tray; and a first tear portion comprising a first tear line defining a boundary of a divided compartment from at least one other divided compartment, the first tear portion configured to facilitate a separation of the defined divided compartment from at least one other divided compartments along the first tear line, wherein at least a portion of the first tear portion has a curvature configuration corresponding to the first tear line to impart rigidity to the first tear portion.

2. The meal tray of claim 1, wherein the first tear line is defined by a plurality of perforations, or a plurality of indentations, or a groove, or a combination thereof.

3. The meal tray of claim 1, wherein the curvature configuration includes a substantially sinusoidal pattern.

4. The meal tray of claim 1, wherein at least a portion of the encompassing wall includes a curvature configuration defined by the curvature of the corresponding first tear line.

5. The meal tray of claim 1, wherein the first tear line comprises a leading nick formed at one end of the first tear line located at an outer perimeter of the encompassing tray rim.

6. The meal tray of claim 1, wherein the meal tray is transparent to microwave energy.

7. The meal tray of claim 1, wherein at least one divided compartment is dimensioned differently than the others.

8. The meal tray of claim 1, further comprising:

a flexible cover sheet coupled to the meal tray and dimensioned to individually seal the open end of each of at least two adjacent divided compartments, the flexible cover sheet comprising a second tear portion including a second tear line configured to facilitate a separation of the adjacent divided compartment along the second tear line to preserve a sealed status of each separated divided compartment.

9. The meal tray of claim 8, wherein the second tear line is positioned to substantially transpose on the first tear line defining the boundaries of the adjacent divided compartments.

10. The meal tray of claim 8, wherein the flexible cover sheet is removably coupled to the meal tray.

11. The meal tray of claim 8, wherein the flexible cover sheet is coupled to the meal tray via adhesive, heat sealing, or a combination thereof.

12. A meal tray comprising:

a plurality of divided compartments each having a substantially planar bottom portion and an encompassing wall extending upwardly therefrom to form an open upper end of the divided compartment, each divided compartment dimensioned to receive a different portion of a meal;

an encompassing tray rim defining the open upper end of the meal tray; and a first tear portion comprising a first tear line defining a boundary of a divided compartment from at least one other divided compartment, the first tear portion configured to facilitate a separation of the defined divided compartment from at least one other divided compartments along the first tear line, wherein at least a portion of the first tear line is defined by a plurality of sub-lines, the plurality of sub-lines intersecting at a substantially abrupt angle, an angular configuration of the first tear line imparts rigidity to the corresponding first tear portion.

13. The meal tray of claim 12, wherein at least a portion of the encompassing wall includes configuration defined by its corresponding first tear line having the plurality of sub-lines intersecting at the substantially abrupt angle.

14. The meal tray of claim 12, wherein the first tear line is defined by a plurality of perforations, or a plurality of indentations, or a groove, or a combination thereof.

15. The meal tray of claim 12, wherein the first tear line comprises a leading nick formed at one end of the first tear line located at an outer perimeter of the encompassing tray rim.

16. The meal tray of claim 12, wherein at least one divided compartment is dimensioned differently than the others.

17. The meal tray of claim 12, further comprising:

a flexible cover sheet coupled to the meal tray and dimensioned to individually seal the open end of each of at least two adjacent divided compartments, the flexible cover sheet comprising a second tear portion including a second tear line configured to facilitate a separation of the adjacent divided compartment along the second tear line to preserve a sealed status of each separated divided compartment.

18. The meal tray of claim 17, wherein the second tear line is positioned to substantially transpose on the first tear line defining the boundaries of the adjacent divided compartments.

19. The meal tray of claim 17, wherein the flexible cover sheet is removably coupled to the meal tray.

20. The meal tray of claim 17, wherein the flexible cover sheet is coupled to the meal tray via adhesive, heat sealing, or a combination thereof.

* * * * *